United States Patent [19]

Cash

[11] 4,223,510

[45] Sep. 23, 1980

[54] FILLING MACHINE FOR SLEEPING BAGS, COMFORTERS AND THE LIKE

[75] Inventor: David R. Cash, Louisville, Ky.

[73] Assignee: James Cash Machine Co., Louisville, Ky.

[21] Appl. No.: 15,900

[22] Filed: Feb. 28, 1979

[51] Int. Cl.[3] ..... B65B 39/06; B65B 39/14

[52] U.S. Cl. ..... 53/258; 53/524

[58] Field of Search ..... 53/524, 255, 258

[56] References Cited

U.S. PATENT DOCUMENTS

| | | | |
|---|---|---|---|
| 2,737,000 | 3/1956 | McCargar | 53/255 X |
| 3,390,509 | 7/1968 | Kamp | 53/524 X |
| 3,664,090 | 5/1972 | Atkin | 53/524 X |

*Primary Examiner*—Travis S. McGehee

*Attorney, Agent, or Firm*—Maurice L. Miller, Jr.

[57] ABSTRACT

A machine for filling a cloth bag with cloth filling material having a series of elongated fingers and a hollow spout mounted on a rectangular frame in registry with one another for movement relative to one another along the frame such that the fingers advance into and retract out of the passageway. A cloth filler material is spread upon the fingers and the bag to be filled is draped over the spout so that the inside bottom of the bag is facing the fingers. An air operated double acting cylinder is actuated to drive an endless cable which cable may either be operatively connected to a roller assembly connected to a rear end portion of the fingers or to the spout depending upon whether it is desired to move the fingers into and out of the spout or move the spout along and over the fingers. Movement of the fingers into the spout or vice versa forces the bottom of the bag through the spout and extends the bag over the fingers and the filler material spread thereon.

6 Claims, 8 Drawing Figures

FILLING MACHINE FOR SLEEPING BAGS, COMFORTERS AND THE LIKE

BACKGROUND OF THE INVENTION

This invention relates generally to machines for filling cloth bodies with cloth stuffing or filling material and specifically to machines for filling sleeping bags, comforters and the like.

Generally speaking, such machines are known in the prior art. See for example the apparatus for packaging a soft resilient foam body disclosed in U.S. Pat. No. 2,693,304 issued to H. C. Davis, et al. on Nov. 2, 1954. This machine compresses the sides of a rectangular foam mattress to reduce its width while at the same time movably inserting the foam mattress into a container spread over a pair of stationary plates. The plates contain endless belt conveyors which advance the foam body into the container which is held stationary during the filling process.

See also U.S. Pat. No. 2,749,690 issued to A. Q. Bridges et al. on June 12, 1956 which discloses a mattress filling machine wherein filling material is forced in a compressed condition into a ticking applied over the outside of a stationary spout. Movable endless chains located on each side of the spout carry the filling into the ticking in a compressed state. U.S. Pat. No. 932,693 issued to F. Franke on Aug. 31, 1909 discloses a mattress stuffer which employs a plunger for pushing a bat of filler material into a tick.

Another such prior art machine is the electrically operated cushion filling machine disclosed in U.S. Pat. No. 2,509,771 issued to M. H. Lang on May 30, 1950 wherein filler material is compressed within a receptacle to permit ease of slipping a cushion over one end of the receptacle. An electrically operated plunger forces the filler into the cushion casing and ejects the filled cushion from the machine.

U.S. Pat. No. 3,319,394 issued to L. Talaly et al. on May 16, 1967 discloses a machine for packaging resilient cellular foam material which employs means for compressing the foam vertically and for advancing the same into a package while at the same time advancing the package over the compressed foam, the package being advanced toward and over the compressed foam at a slower rate of speed than the filler is being advanced into the package.

See also U.S. Pat. No. 3,783,578 issued to A. L. Willis et al. on Jan. 8, 1974 which shows means for compressing a resilient filler and for advancing the same into a stationarily held package, after which the compression forces are released to eject the filler into the bag and eject the filled bag from the machine.

Specifically with regard to machines for filling sleeping bags and comforters, one such apparatus is manufactured by ABM Industries, Inc., 1306-12 South Pulaski Road, Chicago, Illinois 60623. This prior art machine employs a series of elongated fingers disposed side-by-side over a frame, which fingers are movably mounted on tracks along the frame to advance and retract into a spout fixedly attached to a table remote with respect to the frame containing the fingers. One difficulty encountered in the use of this assembly is that the spout is attached to a table separate and apart from the frame containing the fingers, requiring considerable floor space not only when the machine is in use such that the fingers are advanced beyond the machine frame through the spout, but also when the machine is not in use. Another disadvantage of this machine is that the spout, being remote from the fingers, can not be moved toward and over the fingers to save additional factory floor space as can be accomplished by one of the embodiments of my invention.

By means of my invention, therefore, these and other difficulties previously encountered with prior art filling machines are substantially overcome.

SUMMARY OF THE INVENTION

Briefly, in accordance with the objects and principles of my invention, I provide a machine for filling sleeping bags, comforters and the like with filling material having a supporting frame and a plurality of elongated fingers attached to and above the frame and disposed parallel to one another. A spout defining a hollow passageway therethrough is attached to and above the frame, the passageway being in registry with the ends of the fingers. Lastly, means is provided for effecting relative movement of the fingers and spout to advance and retract the fingers at least partially through and out of the passageway.

These and other objects of my invention will become apparent to those skilled in the art from the following detailed description and attached drawings upon which, by way of example, only the preferred embodiments of the present invention are illustrated.

DESCRIPTION OF THE PREFERRED EMBODIMENT

Figure 1:
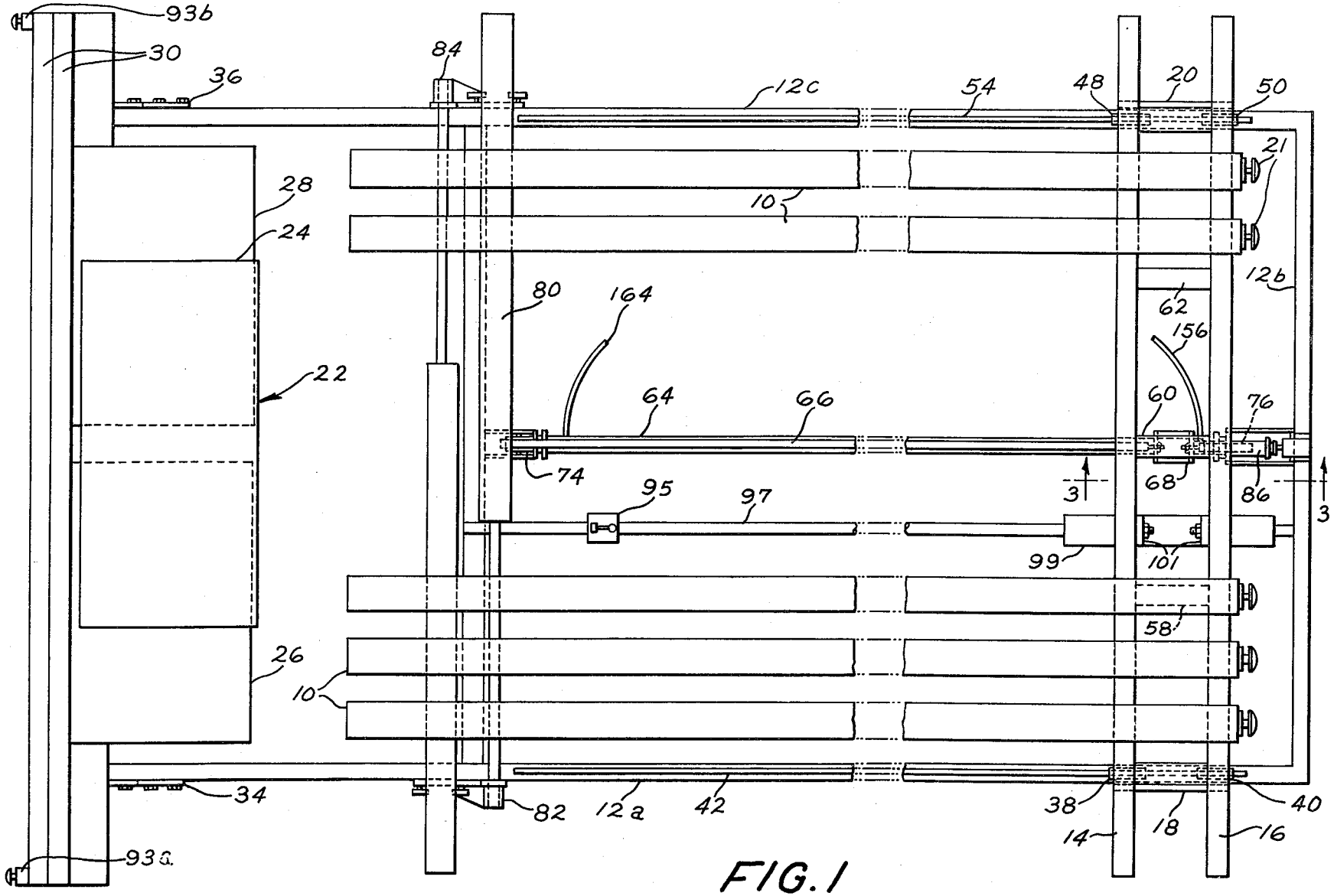
FIG. 1 shows a top plan view of a machine for filling sleeping bags, comforters and the like with some of the finger elements 10 thereof removed for clarity, thus illustrating one preferred embodiment of my invention.

Referring now to FIGS. 1–5, there is shown, in one preferred embodiment of the present invention, a filling machine for comforters, sleeping bags and the like. A plurality of elongated fingers 10 are movably mounted on a rectangular frame 12*a–d*. Specifically, the fingers 10 are slidably attached near rear end portions thereof to a pair of elongated members 14, 16 which extend across the width of the frame 12 and are affixed to plates 18, 20. Screw clamps 21 which secure the fingers 10 to the member 16 may be loosened to permit slidable movement of the fingers 10 to any desired location along the length of the members 14, 16. Notice in FIG. 1 that some of the fingers 10 have been removed near the centerline of the frame 12 so that underlying components may be more clearly seen. The fingers 10 project forward of the elements 14, 16 toward the forward end of the frame 12 in alignment with the mouth of a hollow adjustable width spout 22. The spout 22 is of conventional design having a central portion 24 and a pair of generally U-shaped end portions 26, 28 slidably inserted within the central portion 24. The spout 22 is mounted in a frame 30 which is, in turn, fixedly mounted to a forward end portion of the frame 12 by means of a bracket 32 connected between plates 34, 36. The plates 34, 36 are bolted to forward end portions of frame members 12*a, c*.

A pair of upper rollers 38, 40 are attached to the plate 18 and are rollably mounted upon a track 42 which extends along the upper surface of the frame member 12*a*. A lower roller 44 attached to the plate 18 travels along a track 46 extending along the bottom surface of the member 12*a*. Similarly, a pair of upper rollers 48, 50 and a lower roller 52 are attached to the opposite plate 20 to travel along a track 54 and a track 56 located along the upper and lower surfaces of the member 12*c*. A series of cross-braces 58, 60 and 62 interconnect the members 14, 16 at various points along their length between the plates 18, 20.

The fingers 10 are driven into and out of the spout 22 by a conventional double-action air cylinder 64 connected between the frame members 12*b, d*. The cylinder 64 is connected to a belt or cable 66 which is joined to a U-shaped clamp 68. The clamp 68 is joined to a spacer block 70 which is, in turn, connected to the lower surface of the center cross-brace 60 (See FIGS. 2–3). A pair of air start switches 72*a, b* located on either end of the spout frame 30 are employed to actuate the cylinder 64 in the conventional manner to cause the cable 66 to travel over pulleys 74, 76 and pull the plates 18, 20 along the members 12*a, c* to move the fingers 10 into and thereafter out of the spout 22. The forward end portions of the fingers 10 rest upon elongated rollers 78, 80 which traverse the frame 12 between bearing blocks 82, 84 to maintain the fingers 10 level and accurately aligned with the passage through the spout 22. An elongated element 86 attached to and projecting rearwardly behind the spacer block 70 is aligned to engage a conventional shock absorbing stop 88 to stop the rearward movement of the fingers 10 when the plates 18, 20 reach their full rearward position along the frame members 12*a, c*. A suitable cable air cylinder for use as the cylinder 64 and cable 66 is 200-2-120 inch cable air cylinder as manufactured by Tol-O-Matic, Inc., Minneapolis, Minnesota. The shock absorber 88 may be a SAUD $\frac{3}{4}$ inch$\times$3 inch S-BP as manufactured by Efdyn.

Figure 2:
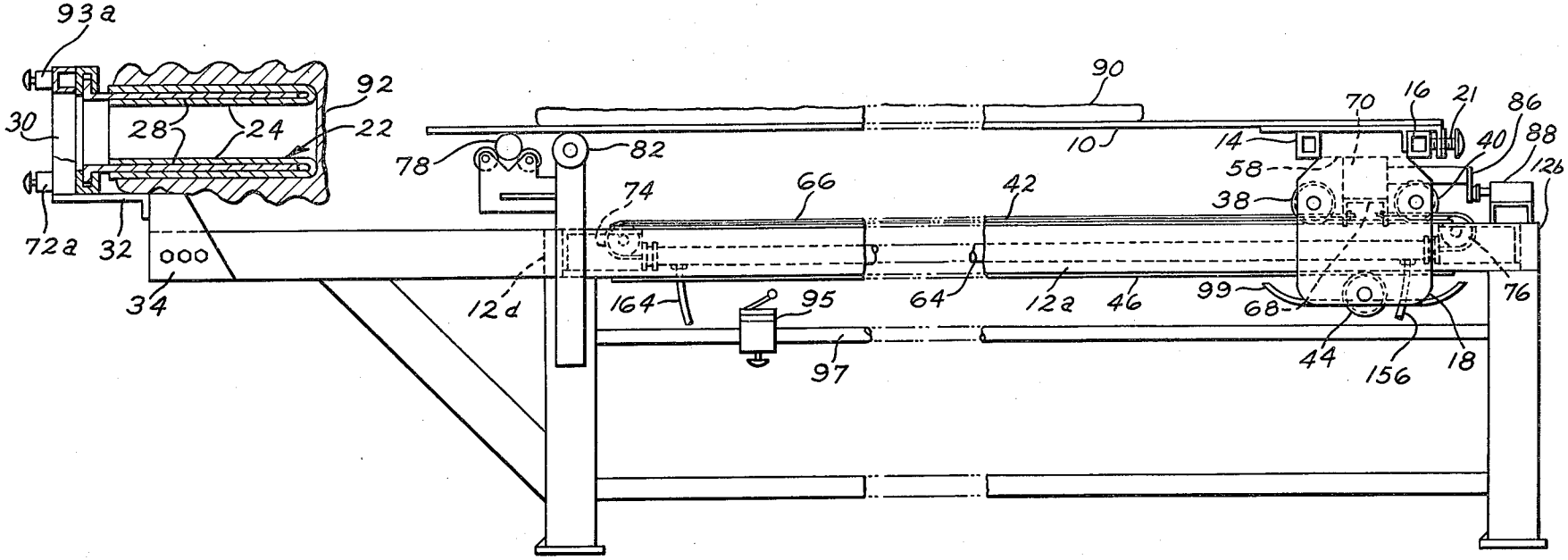
FIG. 2 shows a side elevation view of the machine of FIG. 1 with a portion of the spount 22 of the latter figure located nearest the viewer cut away for clarity, there being a bag and filler material shown on the machine of FIG. 2 for illustrative purposes.

In typical operation of the machine of the present example, a filler material 90 is spread upon the fingers 10 when the fingers 10 are disposed in their fully retracted position behind the mouth of the spout 22 (See FIG. 2). A comforter or sleeping bag 92 is pushed over the mouth of the spout 22 so that the inside bottom of the bag 90 faces the free ends of the fingers 10. Operators depress both of the switches 72*a, b* to actuate the cylinder 64 to drive the fingers 10 forward through the passage in the spout 22 such that the bottom of the bag 92 is forced by the fingers 10 through the spout 22. At the same time, the fingers 10 carry the filler material 90 into the bag 92 to fill the same. Thereafter, the bag 92 with filler material 90 disposed therein is removed by hand from the forward end of the fingers 10 as the fingers 10 return to their retracted starting position. Should an emergency occur during forward movement of the fingers 10, either of two emergency switches 93*a, b* may be depressed to immediately reverse the air drive to the cylinder 64 and return the fingers 10 to their fully retracted starting position in a manner as later more fully explained.

Figure 3:
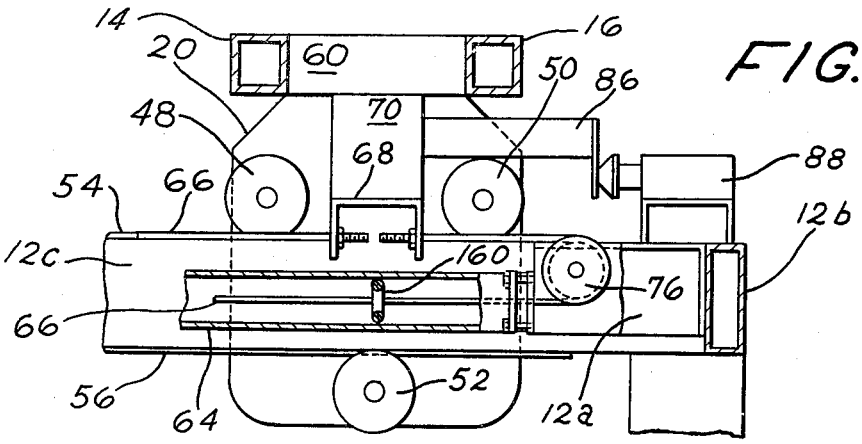
FIG. 3 shows a cross-sectional view of a portion of the machine of FIG. 1 as viewed along cross-section lines 3—3 of the latter figure.
Figure 8:
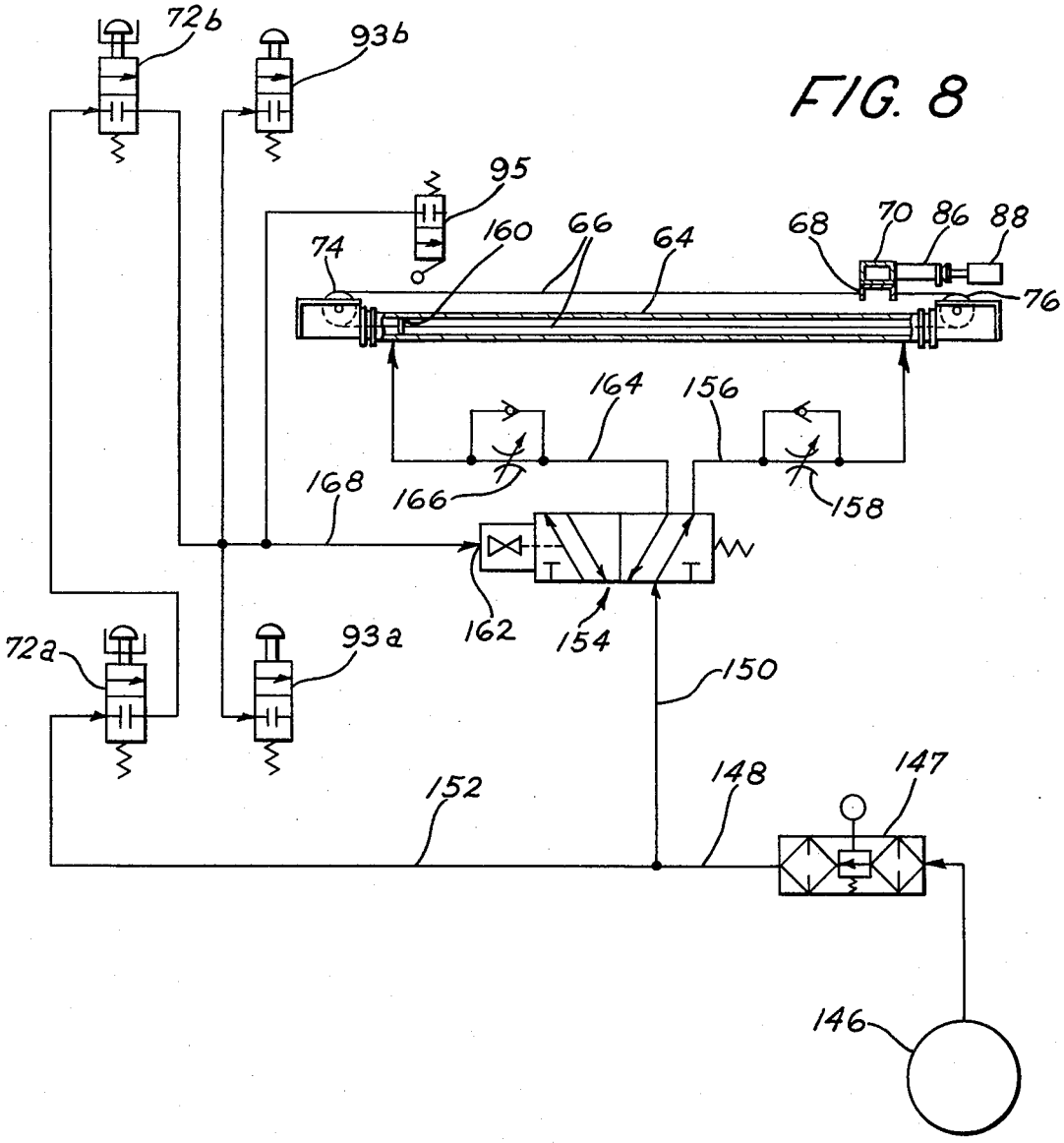
FIG. 8 shows a schematic circuit diagram of a high pressure air system for operation of the machine of FIGS. 1–5.
Figure 4:
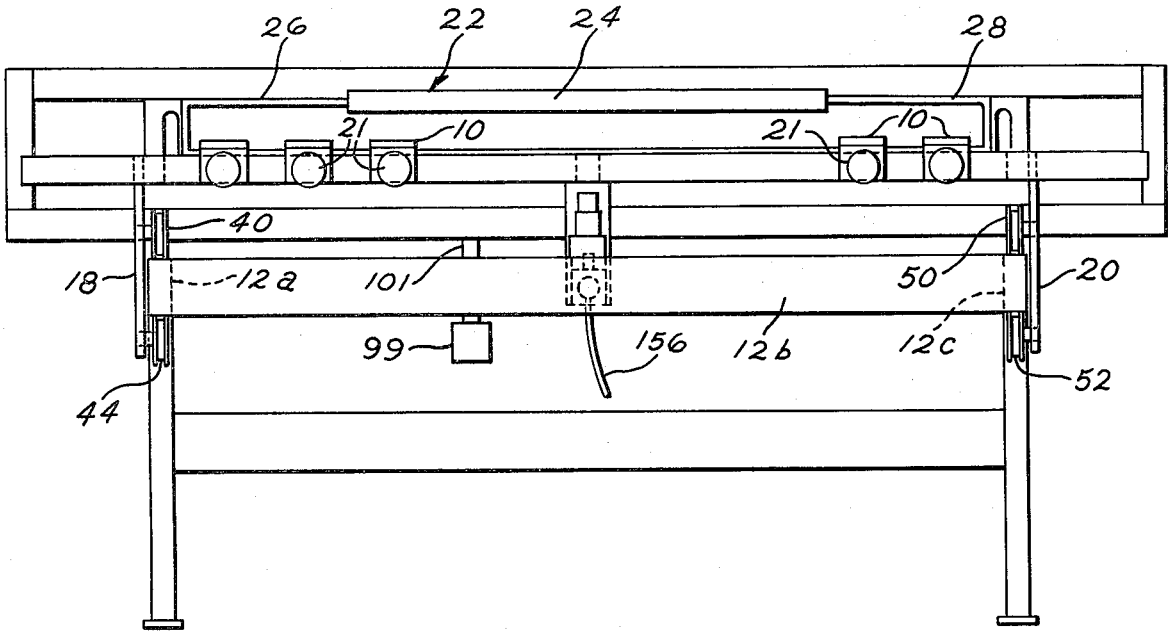
FIGS. 4–5 show rear and front end elevation views, respectively, of the machine of FIGS. 1–3.
Figure 5:
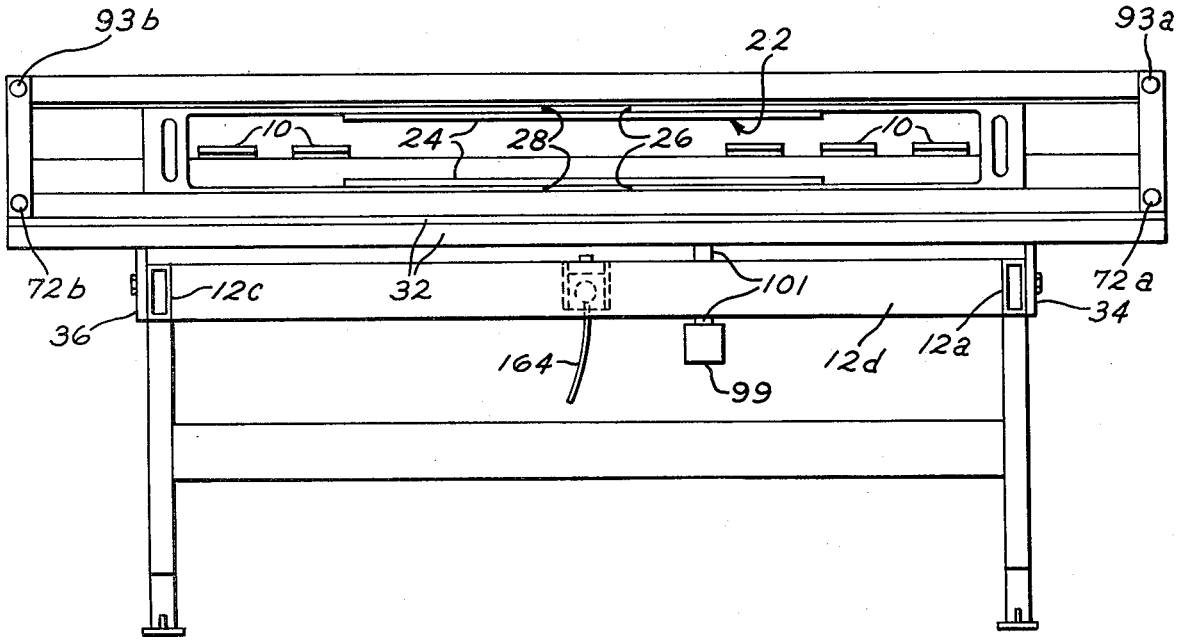

A cam operated air valve 95 is adjustably mounted on an elongated pipe 97 which extends the entire length of the frame 12 underneath the frame members 12*a–d*. The valve 95 is positioned to be actuated by a relatively thin curved plate 99 underslung below the frame members 12*a–d* and suspended from cross-braces 14, 16 for movement therewith by means of elongated vertical support members 101. The valve 95 is of conventional type and when actuated by the leading edge of the curved plate 99, causes the shifting of high pressure input air to the opposite end of the cylinder 64 to immediately reverse the operation thereof and return the fingers 10 to their fully retracted start position, i.e. the position of the fingers 10 as shown in FIGS. 1–3).

Figure 6:
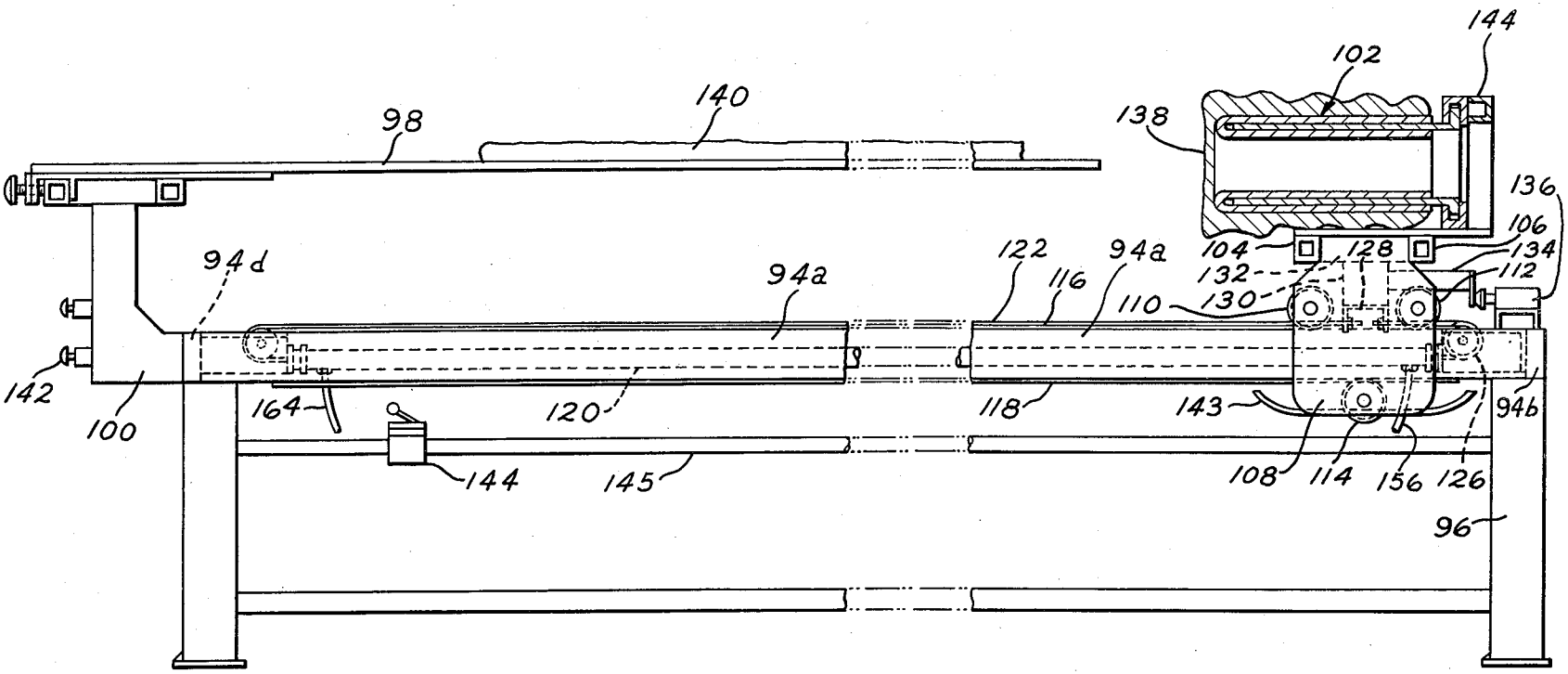
FIGS. 6–7 show side elevation views of a machine for filling sleeping bags, comforters and the like, thus illustrating another preferred embodiment of my invention.
Figure 7:
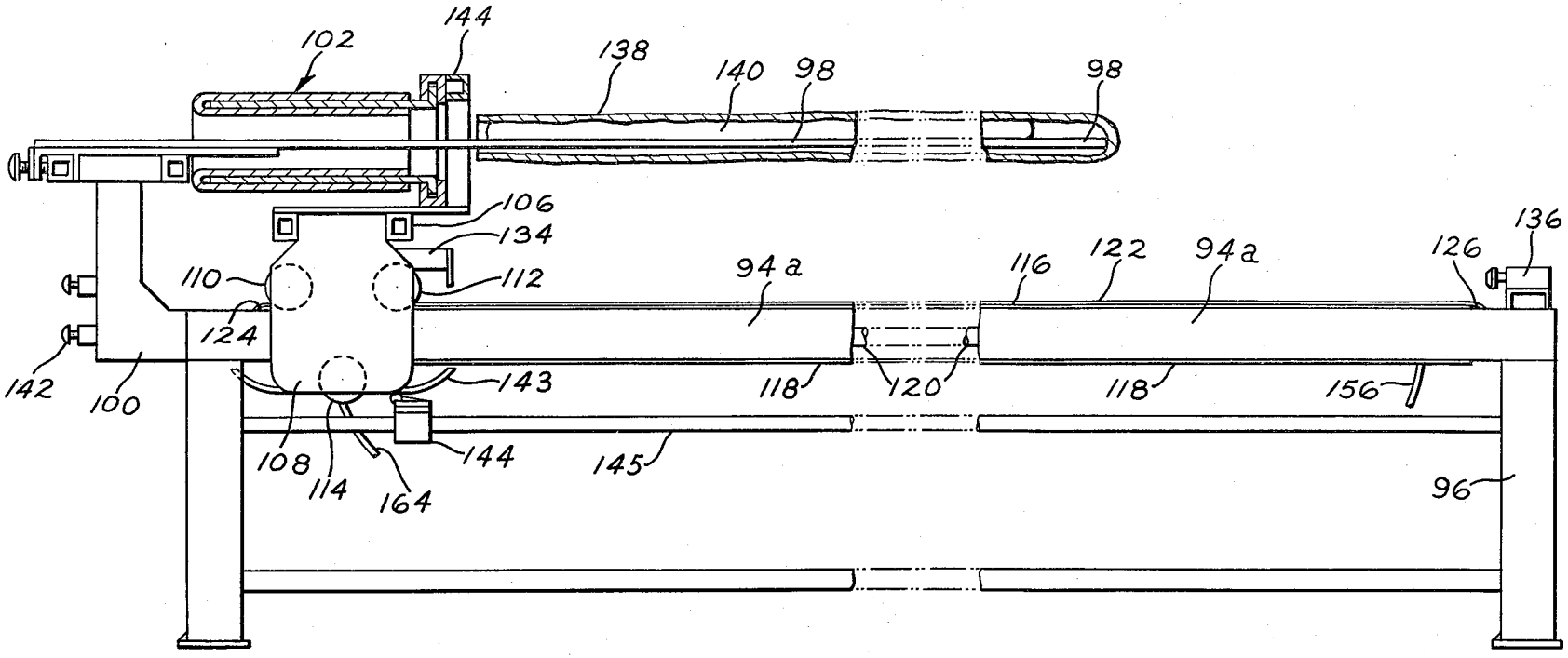

Referring now to FIGS. 6–7, there is shown, in another preferred embodiment of my invention, a filling machine for sleeping bags, comforters and the like which includes a rectangular supporting frame 94*a–d* supported above a floor by legs 96. A series of elongated fingers 98 of rectangular cross-section, similar in construction to the fingers 10 of the previous example, are fixedly attached along rear end portions thereof to a rear end portion of the frame 94 by means of a suitable support 100. As shown in FIG. 6, the fingers 98 are cantilevered forwardly above the frame 94 toward and in line with the mouth of a spout 102. The spout 102, which may be of the adjustable type similar in construction to the spout 22 of the previous example, is movably mounted to the frame 94. A pair of elongated rectangular members 104, 106 extend across the frame 94 and are supported on a pair of plates 108 (only one of which is shown) similar to the plates 18, 20 of the previous example.

Upper rollers 110, 112 and a lower roller 114 attached to each plate 108 are rollably associated with a pair of tracks 116, 118 located along the upper and lower surfaces of the side frame members 94*a, d*, again in a manner similar to the plates 18, 20 and tracks 42, 46 and 54, 56 of the previous example. A double acting air cylinder 120 is connected along the length of the frame 94 between members 94*b* and 94*d* so as to operate a belt or cable 122 drawn around a pair of end pulleys 124, 126. As in the previous example of my invention, the cable 122 is connected to a conventional U-shaped clamp 128 (See FIG. 6 only), which is, in turn, welded or otherwise attached to a spacer block 130. The block 130 is fixedly attached to the bottom of a cross-brace 132 located along the center line of the frame 94 between the members 104, 106.

An elongated member 134 is connected to the rear side of the spacer block 130 and extends rearwardly in line with a conventional shock absorbing stop 136 for engagement with the latter to stop the rearward movement of the spout 102 at the rear of the frame 94. The fingers 98 may be constructed of lightweight aluminum or other metal so as to be readily cantilevered forward along and above the frame 94 from the support 100.

In typical operation, FIG. 6 shows the machine of the present example having a bag 138 to be filled spread across the mouth of the spout 102 so that its inside bottom is facing the free ends of the fingers 98. A mat of filling material 140 is spread across the fingers 98 preparatory to the filling operation when the fingers 98 and spout 102 are in the retracted position shown in FIG. 6.

A pair of air start switches 142, which may be conveniently mounted on the sides of the support 100 similar to the air switches 72*a, b* of the previous example, are actuated to operate the cylinder 120 and cable 122 to drive the plates 108 and spout 102 from their retracted position as shown in FIG. 6 along the frame 94 to their advanced position as shown in FIG. 7 to fill the bag 138 with the filler material 140 and thereafter return the same to the retracted position. One additional advantage of the machine of the present example is the considerable savings in factory floor space that results from its use as compared with the floor space requirement of the machine of the previous example and prior art bag filling machines. Whereas the fingers 10 of the machine of the previous example move through the fixedly mounted spout 22 and thus project a considerable distance beyond the front of that machine, no such length extension occurs in the machine of the present example. A curved plate 143 attached below the members 104, 106 for movement therewith is aligned to depress a cam operated air valve 144 adjustably mounted on a pipe 145 near the end of the desired forward travel position of the plates 108 and fingers 98 to reverse the cylinder 120 and return the fingers 98 to their retracted starting position.

Referring now to FIGS. 1–5 and 8, one example of a suitable high pressure air control circuit for operation of the machine of my invention will now be explained. Since the subject circuit is readily usable in either the finger driven machine of FIGS. 1–5 or the spout driven machine of FIGS. 6–7, its explanation will only be made with respect to the former machine.

High pressure air in the range of from about 40 to 100 psi is supplied from a suitable source 146 to the input port of a conventional air line filter, regulator and lubricator 147 such as a Watts model No. C10-04-FRL. Regulated high pressure air is supplied from the output port of the filter, regulator 147 through a line 148 and branch lines 150, 152 to one of the high pressure air input ports of a four-way, two-position spring return pilot valve 154 and one of the start switches 72*a,* respectively. The pilot valve 154 may be a Humprey model No. 501-4AA and the start switches 72*a, b,* which are two-way, normally-closed, two-position, spring return air valves, may each be a Humprey model No. 125 PLG-2-10-21. High pressure air is therefore normally supplied through the normally-open side of the valve 154 from the line 150 into a line 156 and through a flow control valve 158, such as a Humprey model No. 200A-35, to the right side of the cylinder 64 as viewed in FIGS. 1–3 and 8 to maintain a cylinder disc 160 at the far left of the cylinder 64 such that the clamp 68 and the plates 18, 20 are maintained at the rear of the frame 12 with the shock absorber 88 compressed by the member 86.

To start the movement of the plates 18, 20 along the tracks 42, 46 and 54, 56 to drive the fingers 10 forwardly through the spout 22, both of the start switches 72*a, b* on opposite sides of the frame 12 must be depressed simultaneously by two different operators since these switches are series connected with one another, for safety reasons, between the line 152 and a control port 162 of the valve 154. Such action shifts air from the line 156 to a line 164 connected through another flow control valve 166, similar to the valve 158, and into the left end of the cylinder 64 to thus drive the disc 160 toward the rear of the frame 12 while drawing the cable 66 and clamp 68 forwardly. Accordingly, the fingers 10 are driven into the spout 22.

As the clamp 68 approaches the forward end of the cylinder 64, the curved plate 99 (FIGS. 1–2) drawn along therewith eventually engages and actuates the switch 95 which is a two-way, cam-operated, normally-closed, spring return air valve such as a Humprey model No. 280C-3-10-21. Actuation of the switch 95 by the plate 99 opens the same to dump air from a line 168 to thus reduce the air pressure at the port 162 and allow the valve 154 to shift back to the state indicated in FIG. 8. Accordingly, high pressure air is shifted off of the line 164 and back onto the line 156 to drive the disc forwardly once again and return the clamp 68 and fingers 10 to the rear of the frame 12 to compress the stop 88.

Should an emergency occur while the fingers 10 are moving forward on the frame 12 but before the plate 99 advances far enough to actuate the cam switch 95, either one of the operators standing on either side of the machine opposite the spout 22 can immediately reverse the movement of the disc 160 and the fingers 10 by depressing one of the emergency stop switches 93*a* or *b*. Unlike the series connection of the start switches 72*a, b,* requiring that both the simultaneously depressed to drive the fingers 10 forwardly, the stop switches 93*a, b* are normally-closed, two-position, spring return valve switches connected in parallel with one another and to the line 168. Thus, upon depressing either of the switches 93*a* or *b* to open the same, air is dumped from the line 168 to reduce the pressure at the port 162 and permit the spring return action of the valve 154 to return the latter to its normal state such that the line 156 is pressurized to drive the disc 160 forwardly of the frame 12 to return the fingers 10 to their retracted position.

Although the subject invention has been described with respect to specific details of two preferred embodiments thereof, it is not intended that such details limit the scope of the present invention otherwise than as is set forth in the following claims.

I claim:

1. A machine for filling sleeping bags, comforters and the like with filling material comprising a supporting frame, a plurality of elongated fingers fixedly attached to and above said frame and disposed parallel to one another, a spout defining a hollow passageway therethrough movably attached to and above said frame, said passageway being in registry with the ends of said fingers, and means for effecting movement of said spout along said frame to advance and retract said fingers through and out of said passageway for carrying and extending a bag spread around said spout along and around said fingers and a filling material spread upon said fingers, to thereby fill said bag.

2. The machine of claim 1 wherein said spout and fingers are adjustable in width across said frame.

3. The machine of claim 1 wherein said effecting means comprises a double acting air cylinder connected to said frame, a cable connected to said cylinder for movement therewith in a direction parallel to said fingers, and means connecting said spout to said frame for advancing and retracting said spout toward and away from said fingers such that said fingers advance into and retract out of said passageway, said connecting means being responsively attached to said cable for movement therewith along said frame.

4. The machine of claim 3 wherein said connecting means comprises a pair of plates disposed along the sides of said frame, a series of rollers connected to each of said plates, track means disposed on each of said sides of said frame and extending in a direction parallel to the longitudinal dimension of said fingers, said rollers of each of said series being mounted on said track means, spout supporting means extending above and across the width of said frame and connected to said plates, and means connecting said cable to said supporting means.

5. The machine of claim 3 wherein said fingers are fixedly attached along rear end portions thereof to one end of said frame and are cantilevered forwardly of said frame toward and in alignment with said passageway in said spout.

6. A machine for filling sleeping bags, comforters and the like with filling material comprising a supporting frame, a plurality of elongated fingers movably attached to and above said frame and disposed parallel to one another, a spout defining a hollow passageway therethrough fixedly attached to and above said frame, said passageway being in registry with the ends of said fingers, and means for effecting movement of said fingers to advance and retract said fingers at least partially through and out of said passageway, said effecting means comprising a double acting air cylinder connected to said frame, a cable connected to said cylinder for movement therewith in a direction parallel to said fingers, a pair of plates disposed along the sides of said frame, a series of rollers connected to each of said plates, track means disposed on each of said sides of said frame and extending in a direction parallel to the longitudinal dimension of said fingers, said rollers of each of said series being mounted on said track means, finger supporting means extending above and across the width of said frame and connected to said plates, said fingers being connected along rear end portions thereof to said supporting means, and means connecting said cable to said supporting means, whereby said fingers are movable into and out of said spout for advancing a filling material spread upon said fingers into a bag spread around said spout and for extending said filled bag along and around said fingers.

* * * * *